United States Patent [19]

Goldthorp et al.

[11] 4,224,654

[45] Sep. 23, 1980

[54] RELAY DRIVER CIRCUIT

[75] Inventors: David C. Goldthorp, Reading, Pa.; Frank P. Tuhy, Jr., Montville, N.J.

[73] Assignee: Bell Telephone Laboratories, Incorporated, Murray Hill, N.J.

[21] Appl. No.: 974,390

[22] Filed: Dec. 29, 1978

[51] Int. Cl.³ ..... H01F 27/42

[52] U.S. Cl. ..... 361/152; 361/190

[58] Field of Search ..... 361/152, 153, 154, 159, 361/160, 189, 190, 205, 139

[56] References Cited

U.S. PATENT DOCUMENTS

| | | | |
|---|---|---|---|
| 3,268,776 | 8/1966 | Reed | 361/154 |
| 3,646,402 | 2/1972 | Condon et al. | 361/156 |

FOREIGN PATENT DOCUMENTS

| | | | |
|---|---|---|---|
| 1103557 | 2/1968 | United Kingdom | 361/190 |

OTHER PUBLICATIONS

GE SCR Manual ® 1967, p. 7.

*Primary Examiner*—Harry E. Moose, Jr.
*Attorney, Agent, or Firm*—Robert O. Nimtz

[57] ABSTRACT

A relay driver circuit is disclosed in which a relay coil is operated by enabling the collector-emitter path of a switching transistor. In order to avoid damage to the transistor from voltages induced in the relay coil when the relay is turned off, an isolating semiconductor device is inserted between the transistor and the relay coil. This semiconductor device is operated in synchronism with the driving transistor and thus isolates the driving transistor from transients during the de-energization of the relay.

2 Claims, 3 Drawing Figures

RELAY DRIVER CIRCUIT

BACKGROUND OF THE INVENTION

1. Field of the Invention

This invention relates to relay driver circuits and, more particularly, to isolating circuits for protecting semiconductor components from large induced voltages during relay switching.

2. Description of the Prior Art

It has become common to operate relays by means of transistor switching circuits. Since semiconductor technology is increasingly taking the integrated circuit form and since the switching of large signals can be best accommodated with relay technology, a transistor driven relay is a convenient interface between these two technologies.

It is likewise known to connect a unidirectional conducting device across a relay coil to prevent large induced reverse voltages from building up across the relay coil when current is interrupted through the cell winding. This arrangement operates well to prevent the driving transistor from being exposed to excessive forward voltages which might cause secondary breakdown. Unfortunately, however, it is desirable to permit a modest reverse voltage during the turn-off portion of a relay operation cycle in order to speed up relay release. A zener diode in series with the unidirectional conducting device permits such a modest reverse voltage. This reverse voltage combines additively with the supply voltage at the switching transistor. Low voltage transistors, particularly when fabricated in integrated circuit form, often break down with the high forward voltages this combination produces.

SUMMARY OF THE INVENTION

In accordance with the illustrative embodiment of the present invention, a semiconductor isolation device is connected between the relay coil and the driving transistor. The isolation device is driven in synchronism with the switching transistor and, when in the OFF condition, presents a very high breakdown voltage which effectively isolates the driving transistor from damaging voltages.

The isolating semiconductor device may take the form of a discrete silicon controlled rectifier or may be fabricated in integrated circuit form with two low voltage transistors cross-connected to provide a controlled rectifier characteristic.

The major advantage of the present invention lies in protecting low voltage integrated circuited transistors from high transient voltages and accomplishing this result with semiconductor devices which may themselves be fabricated in integrated circuit form.

DETAILED DESCRIPTION

Figure 1:
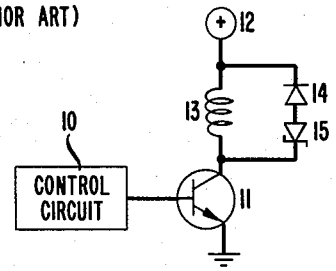
FIG. 1 (PRIOR ART)
FIG. 1 is a circuit diagram of a prior art relay driving circuit.

Referring more particularly to FIG. 1, there is shown a circuit diagram of a prior art relay driving circuit comprising a control circuit 10 which provides a switching signal to the base of transistor 11. The signal from circuit 10 alternately enables or disables the base-emitter junction of transistor 11. When the base-emitter junction of transistor 11 is enabled, the collector-emitter path of transistor 11 is switched to an easy conduction state and current flows from positive voltage source 12 through relay winding 13 and the collector-emitter path of transistor 11 to ground. Being thus energized, relay winding 13 operates relay contacts (not shown) to perform the desired control function.

When control circuit 10 disables the base-emitter junction of transistor 11, transistor 11 turns off, presenting a high impedance across its collector-emitter path. The interruption of the current flow through the conductive winding 13 induces a voltage across winding 13 with a polarity positive at the bottom end of winding 13 and negative at the top end of winding 13. This voltage combines additively with the voltage from source 12 and might be large enough to cause secondary breakdown in transistor 11, damaging the transistor. This problem is particularly acute for transistors fabricated in integrated form where secondary breakdown is likely to occur at moderate voltage levels.

In order to control the reverse voltage, and in accordance with the prior art, a unidirectional conducting device or diode 14 is connected across relay winding 13 and poled in a direction to short-circuit voltages induced across winding 13 which are polarized in the easy conduction direction of diode 14. Since a moderate reverse voltage is desirable to speed up the release of the relay, a zener diode 15 is connected in series with diode 14. Zener diode 15 has a breakdown voltage sufficiently large to permit a moderate reverse voltage to develop across relay coil 13. This zener voltage threshold is selected to guarantee the desired release time for the relay.

The circuit arrangement of FIG. 1 operates well as a relay driver circuit for high voltage transistors. Unfortunately, however, many transistors fabricated in integrated circuit form are low level devices (using buried collector technology, for example) and subject to damage from secondary breakdown when excessive forward voltages are applied across the collector-emitter path. The combined winding induced reverse voltage and the voltage of source 12 applied directly across the collector-emitter electrodes of transistor 11 may well exceed the secondary breakdown voltage.

Figure 2:
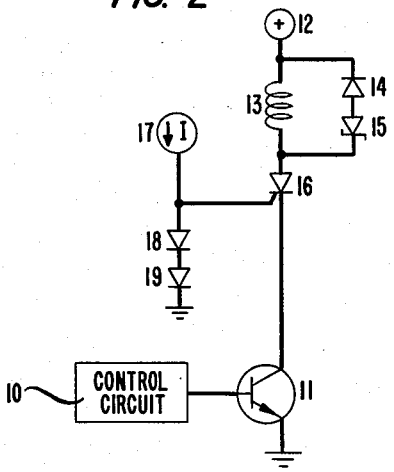
FIG. 2 is a circuit diagram of a relay driving circuit using a silicon controlled rectifier as an isolation device in accordance with the present invention.

In FIG. 2 there is shown a circuit diagram of a relay driving circuit including a semiconductor isolating device 16 for protecting transistor 11 from secondary breakdown. The components of FIG. 2 common to FIG. 1 are identified by the same reference numerals as those used in FIG. 1. Thus control circuit 10 alternately enables and disables the collector-emitter path of transistor 11. When enabled, transistor 11 provides an easy conduction path from voltage source 12 through relay coil 13 and semiconductor device 16 to ground potential. As previously described, diode 14 and zener diode 15 permit a moderate reverse voltage when the relay coil is de-energized. Semiconductor device 16, however, is interposed between coil 13 and transistor 11 and isolates transistor 11 from large voltages in the forward direction. Semiconductor device 16 might comprise, for example, a discrete silicon controlled rectifier having its anode connected to coil 13 and its cathode connected to the collector of transistor 11. The control electrode of silicon controlled rectifier 16 is connected to a circuit including a controlled current source 17 and a plurality of diodes 18 through 19 connected in series to ground potential. Source 17 provides a very small current, typically on the order of a few tens of microamperes, which flows through diodes 18 through 19.

When transistor 11 is enabled by a signal from control circuit 10 which forward biases the base-emitter junction of transistor 11, a low impedance path is immediately created from the current source 17 through the cathode electrode of silicon controlled rectifier 16 and the collector-emitter path of transistor 11. In response to this current to the electrode of device 16, it becomes enabled and current is able to flow from source 12 through relay coil 13, silicon controlled rectifier 16 and transistor 11 to ground potential. Since the impedance of device 16 is very low when enabled, relay coil 13 is immediately energized to operate the relay contacts.

When control circuit 10 turns transistor 11 off, the operating current for device 16 is terminated (switched back to diodes 18 and 19) and device 16 is disabled. Device 16, however, has an extremely high impedance in this condition and isolates transistor 11 from the voltage at the bottom of winding 13. In addition, diodes 18 and 19 form a clamp which limits the voltage on the collector of transistor 11 to less than the forward voltage drop of the diodes 18 and 19. Thus, in accordance with the present invention, a reverse voltage is allowed to assist in the rapid release of the relay while at the same time the driving transistor is isolated from this higher voltage.

Figure 3:
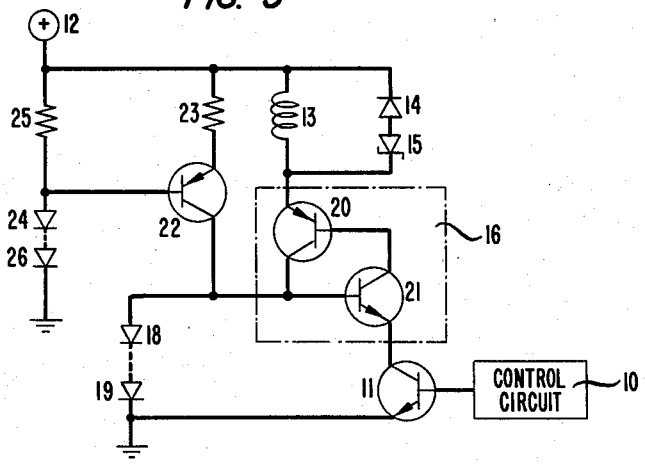
FIG. 3 is a circuit diagram of a relay driver circuit using cross-connected complementary transistors as an isolating device in accordance with the present invention.

Referring to FIG. 3, there is shown a complete circuit diagram of another embodiment of the present invention in which the silicon controlled rectifier is replaced by a pair of complementary transistors which may be fabricated in integrated circuit form on the same chip as transistor 11. Again, the components of FIG. 3 which are identical to those in FIG. 1 or 2 are identified with the same reference numerals. Thus, control circuit 10 is connected to the base of transistor 11 and alternately enables and disables the collector-emitter path of transistor 11. A relay coil 13 is energized by a voltage source 12 when transistor 11 is enabled. Diode 14 and zener diode 15 permit a modest reverse voltage across coil 13 to speed up relay release. In FIG. 3, the silicon controlled rectifier 16 of FIG. 2 has been replaced with a pair of complementary transistors 20 and 21. Transistor 20 is a low-gain lateral PNP device with a collector-emitter sustaining voltage approximately equal to its collector-base breakdown voltage. Transistor 21 is a high-gain vertical NPN device with a collector-emitter sustaining voltage much less than its collector-base breakdown voltage. The base of transistor 20 is connected to the collector of transistor 21 and the base of transistor 21 is connected to the collector of transistor 20. The emitter of transistor 20 is connected to winding 13 while the emitter of transistor 21 is connected to the collector of transistor 11. The combination of transistors 20 and 21 comprises a PNPN device which operates in the same manner as silicon controlled rectifier 16 in FIG. 2. The controlled current source 17 of FIG. 2 is implemented in FIG. 3 with a transistor 22 having its emitter electrode connected through resistor 23 to voltage source 12 and having its collector electrode connected to the base of transistor 21. The base of transistor 22 is biased by the voltage drop across diodes 24 through 26. Diodes 24 through 26, in turn, are energized by voltage source 12 through resistor 25. Of course, for a simpler current source, transistor 22, diodes 24 through 26 and resistor 23 can be omitted, and resistor 25 can be directly connected to the anode of diode 18.

Transistor 22 delivers a fixed small current, the value of which is determined by the value of resistors 23 and 25. Resistor 23 is chosen such that the value of this current is on the order of a few tens of microamperes, as discussed above.

The balance of a circuit for FIG. 3 operates identically to that shown in FIG. 2. When transistor 11 is initially enabled, current flow normally going through diodes 18 and 19 is switched to the base-emitter path of transistor 21. When thus enabled, transistor 21 initiates conduction in the base-emitter path of transistor 20. The feedback from the collector of transistor 20 to the base of transistor 21 rapidly saturates both of transistors 20 and 21. Relay coil 13 is therefore energized to operate the relay contacts.

When transistor 11 is turned off, the base-collector path of transistor 21 can no longer sustain current flow. Transistor 20 is thereby likewise disabled. The cross-connection feedback causes the rapid disablement of both of transistors 20 and 21 and the drive current from transistor 22 switches back to diodes 18 and 19. Diodes 18 and 19, through the base-emitter junction of transistor 21, limit the OFF voltage on the collector of transistor 20 to less than the forward diode drops of diodes 18 and 19. In this way, the higher base-collector breakdown voltage of transistor 21 and the higher emitter-collector sustaining voltage of transistor 20 are substituted for the lower emitter-collector sustaining voltage of transistor 11. Therefore, as long as the sustaining voltage of transistor 20 is not exceeded, effective isolation occurs.

It can be seen that the arrangements of the present invention protect integrated circuit semiconductor devices from excessive forward voltages when used as a relay driver. This protection can be obtained as shown in FIG. 3 by means of devices which themselves can be fabricated in integrated circuit form. The entire relay drive circuit can therefore be fabricated in integrated circuit form to take advantage of the reduced size and cost afforded by this technology. In addition, since only very low currents are needed to initiate the turn-on of transistors 20 and 21, the increase in drive current, compared to the drive current used in FIG. 1, is negligible.

Finally, the circuits of the present invention can be used in other applications where low voltage integrated transistors are used to drive high voltage output devices or circuits. Transistors 20 and 21 together comprise a PNPN device which provides excellent voltage isolation and yet requires a negligible drive current.

We claim:

1. A relay driver circuit including a transistor switch CHARACTERIZED BY a semiconductor isolation device connected between the relay coil and said transistor switch, means for enabling said isolation device in synchronism with said transistor switch, said enabling means comprising a constant current source and means responsive to said constant current source for enabling said isolation device whenever said transistor switch is enabled, and a load connected to said constant current source, said load providing a larger impedance to said constant current than the combination of said isolation device and said switching transistor.

2. The relay driver circuit according to claim 1 CHARACTERIZED IN THAT said load comprises a plurality of diodes connected in their direction of easy conduction.

* * * * *

UNITED STATES PATENT AND TRADEMARK OFFICE

CERTIFICATE OF CORRECTION

PATENT NO. : 4,224,654

DATED : September 23, 1980

INVENTOR(S) : David C. Goldthorp and Frank P. Tuhy, Jr.

It is certified that error appears in the above-identified patent and that said Letters Patent are hereby corrected as shown below:

Column 1, line 22, "cell" should read --coil--.
Column 4, line 1, "resistor 23" should read --resistor 25--; line 2, "25" should read --23--.

Signed and Sealed this

*Third* Day of *February 1981*

[SEAL]

*Attest:*

RENE D. TEGTMEYER

*Attesting Officer*

*Acting Commissioner of Patents and Trademarks*